United States Patent [19]

Vienna et al.

[11] 4,125,471

[45] Nov. 14, 1978

[54] SULFURIZED OIL

[75] Inventors: Paul C. Vienna, Calumet City; Marvin J. Den Herder, Olympia Fields; Alex Zletz, Naperville, all of Ill.

[73] Assignee: Standard Oil Company a corporation of Indiana, Chicago, Ill.

[21] Appl. No.: 821,393

[22] Filed: Aug. 3, 1977

[51] Int. Cl.[2] ..... C10M 3/06; C10M 1/38; C10M 3/32; B21B 45/02

[52] U.S. Cl. ..... 252/31; 72/42; 252/45

[58] Field of Search ..... 252/31, 45; 72/42

[56] References Cited

U.S. PATENT DOCUMENTS

| | | | |
|---|---|---|---|
| 1,824,523 | 9/1931 | Adams | 252/45 |
| 2,142,916 | 1/1939 | Parkhurst | 252/45 |
| 2,222,643 | 11/1940 | Zimmer et al. | 252/45 |
| 2,246,282 | 6/1941 | Zimmer et al. | 252/45 |
| 2,296,037 | 9/1942 | Kaufman | 252/45 |
| 2,356,843 | 8/1944 | Henry | 252/45 |
| 2,669,560 | 2/1954 | Sperry | 252/31 |

FOREIGN PATENT DOCUMENTS

| | | | |
|---|---|---|---|
| 557,756 | 12/1943 | United Kingdom | 252/31 |

*Primary Examiner*—Irving Vaughn

*Attorney, Agent, or Firm*—Mark J. DiPietro; Arthur G. Gilkes; William T. McClain

[57] ABSTRACT

A stable free sulfur containing mineral oil is produced in a two-step process. The first step of the process comprises producing a sulfurized solubilizing oil by reacting a lubricant oil with elemental sulfur until the uncombined sulfur content is less than about 0.5%. The second step comprising dissolving in the oil a quantity of sulfur such that the final concentration of uncombined sulfur is less than 2.0%.

14 Claims, No Drawings

SULFURIZED OIL

BACKGROUND

1. Field of Invention

The present invention relates to improved sulfurized oils and to methods for making the same. More particularly, this invention relates to a process for producing a sulfurized oil for extreme pressure lubrication and metal cutting processes.

2. Description of the Prior Art

This invention relates to an improved sulfur-containing lubricant suitable for use in preparing lubricating oil compositions having improved extreme pressure properties for metalworking purposes.

Mineral lubricating oils containing sulfurized addition agents have been extensively used as metalworking lubricants and especially as cutting oils. In recent years, it has been found that the mineral oil component of such lubricants contain constituents that may be toxic or carcinogenic in nature and therefore undesirable due to the potential harm that might occur when brought in contact with the human body. It has been found that the polycyclic aromatic constituents naturally present in most mineral lubricating oils are the undesirable constituents. Accordingly, it is necessary to remove these constituents from the oil in order to have a mineral lubricating oil suitable for the preparation of metalworking oils that are not harmful to the human body. The polycyclic aromatics are highly polar and can be removed by suitable solvent extraction methods well known to the art. Naturally occurring paraffinic or naphthenic petroleum oils or solvent extracted oils contain less than about 10 percent carbon in aromatic bonding, as determined by the n-d-M Method used for determining the hydrocarbon type analysis of lubricating ols, have been found to be relatively free of toxicity and carcinogenicity characteristics. A description of the n-d-M Method may be found in "Aspects of the Constitution of Mineral Oils" by K. Van Nes and H. A. Van Westen, Elsevier Publishing Co., Inc., New York, 1951. Such oils containing minor amounts of the polar aromatic constituents are relatively poor vehicles for retaining sulfur in an active form. Such oils are now used as the principal component of commercial metalworking lubricants.

It has been known for many years that sulfur increased load bearing capacity of oils for lubrication of hypoid and other gears where extreme pressures may be encountered. In metalworking and the like, many such oils have been and are now used for metal cutting purposes. In some cases the mineral oils have been sulfurized directly. In other compositions, materials such as lard and fatty oils are sulfurized and are added to the mineral oil base. Both types of the products serve the purpose but at the same time have disadvantages. It is difficult to sulfurize directly the highly refined base oils needed to avoid toxicological problems. The amount of sulfur that can be incorporated is insufficient to provide satisfactory performance and frequently sulfur deposits out during storage. Sulfurized fatty oils do not perform satisfactorily in heavy duty machining operations. Free sulfur containing mineral oils commonly contain generally less than 2.0% of sulfur in a stable composition and must be controlled to a narrow range of free sulfur to maximize sulfur concentration and sulfur stability. In processes currently used difficulties in controlling reaction rates and sulfur content are encountered. Some of these difficulties arise in the need to closely monitor the sulfur content of the mineral oil during long reaction time by withdrawing samples during reaction. Poor control over sulfur content of the final product is due to the difficulty in obtaining rapid analyses needed to predict final sulfur content.

The degree of refining that a mineral oil receives as well as its origin, hence composition, influences the ease of incorporation of free sulfur. Thus, unextracted oils containing aromatics such as mid-continent distillates need to be heated only to about 300°–320° F. to incorporate appreciable, up to (about 1.5%, free sulfur in a stable form. On the other hand, it is quite difficult to produce appreciable free-sulfur containing oils from mid-continent mineral oils from which aromatics have been extracted.

The present invention is directed to a process which produces appreciable free sulfur containing oils from highly refined extracted base oils. More specifically, the present invention is directed to a process in which a sulfurized oil which contains less than about 0.5% uncombined sulfur and about 0.1–5.0% combined sulfur is used to stabilize elemental sulfur to produce a mineral oil containing about 1.0 to about 2.0% of uncombined sulfur. Combined sulfur is sulfur which when contacted with the oil reacts with the oil and becomes chemically bound by the oil molecules. Uncombined sulfur is sulfur which when heated with stabilizing oil is held in solution, and is not chemically bound by the oil molecules. The uncombined unreacted sulfur is the component of the oil which provides the extreme pressure and metal cutting lubricant properties. The disclosed process has short reaction times and is convenient to use. It requires little analytical monitoring and produces a sulfurized mineral oil with a controlled sulfur content. The sulfurized oil product has excellent extreme pressure, load bearing and metal working properties. Thus, it is an object of this invention to produce a novel improved sulfurizing process for lubricating oils. Another object of the invention is to produce a sulfur solubilizing mineral oil composition. Still another object of the invention is to produce a novel sulfurized lubricating oil which provides superior lubrication in high pressure and metal working environments. A further object of the invention is to produce a sulfurized mineral oil which is very stable. Another object is to provide a process more suitable for carrying out as a continuous process. Patents which claim processes producing sulfurized mineral oils are U.S. Pat. No. 1,824,523 and U.S. Pat. No. 2,222,643. The U.S. Pat. No. 1,824,523 claims the method of producing a sulfurized cutting oil which comprises incorporating into a hydrocarbon oil free from fatty oil and containing initially at least 0.75% sulfur additional sulfur sufficient to bring the total sulfur content of the oil to at least 2%. U.S. Pat. No. 2,222,643 claims a composition of matter comprising sulfurized monohydric aromatic extract of a mineral lubricating oil fraction, said sulfurized extract being prepared by such acting monohydric aromatic extract to the action of elemental sulfur in an amount between about 1% and about 10% by weight at a temperature between about 300° F. and 375° F., followed by cooling to below 250° F.

Free sulfur has limited solubility in refined mineral oils. The maximum solubility is about 0.4%. A solvent or solubilizing material is needed to be present in the oil to solubilize and stabilize sulfur. Very effective sulfur solubilizing products are achieved when the mineral oil itself is converted to such a material. To produce a solubilizing oil a mineral oil may be retracted with sufficient sulfur to give a sulfurized oil which will solubilize enough free sulfur to give extreme pressure properties to the lubricant oil.

SUMMARY OF THE INVENTION

Disclosed is a process, product by process and lubricant oil containing product by process for the manufacture of stable free sulfur containing mineral oil comprising the steps of contacting elemental sulfur with a mineral oil at a temperature of from about 375° F. to about 500° F. until less than about 0.5% of the oil by weight is uncombined sulfur and the bulk of the sulfur is combined chemically with the oil producing a mineral oil-sulfur composition. Cooling the mineral oil-sulfur composition to a temperature from about 240° F. to about 300° F. and contacting the cool sulfurized mineral oil with sulfur in such an amount that the final concentration of the uncombined sulfur is less than 2.0%. The process for the manufacture of a stable free sulfur containing mineral oil may also comprise the steps of contacting a lubricant oil with a first amount of elemental sulfur which is about 0.1 to about 5% by weight of the oil at a temperature of from about 375° F. to about 500° F. for a period of about 1 minute to about 24 hours until the uncombined sulfur is less than 0.5% by weight of lube oil, producing a lubricant oil-sulfur composition, cooling the oil-sulfur composition to a temperature from about 200° F. to about 350° F. and contacting the lubricant oil-sulfur composition with elemental sulfur in a second amount which results in a stable sulfurized oil which contains less than 1.60% uncombined free sulfur by weight. The first amount of elemental sulfur contacted with the oil may be from about 1 to about 4% by weight of oil preferably from about 2 to about 3% by weight of lubricant oil. The second amount of elemental sulfur in the process may be from about 0.5 to about 1.8% by weight of lubricant oil preferably 0.9 to about 1.5% by weight of lubricant oil. The lubricant oil in this process may commonly be solvent extracted, and generally dewaxed. The preferred lubricant oil has a minimum viscosity at 100° F. of 60 saybolt universal seconds and a maximum viscosity 100° F. of 500 saybolt universal seconds.

The process for the manufacture of stable free sulfur mineral oil may also comprise the steps of heating a solvent extracted lubricant oil to a temperature of from about 425° F. to 475° F. contacting this heated solvent extracted oil with a first amount of elemental sufur which is from about 2% to about 3% by weight of the oil permitting the oil and the sulfur to react for a period of time such that the concentration of uncombined sulfur is less than 0.5% by weight of oil, producing an oil-sulfur composition, cooling the oil-sulfur composition to a temperature of from about 250° to about 275° by adding lubricant oil and contacting the oil-sulfur composition with a second amount of sulfur which is from about 1.0 to about 1.5% by weight of the oil mixture until the sulfur is fully dissolved and then cooling the product to room temperature.

The process to manufacture a sulfurized lubricant oil used to solubilize elemental sulfur may also comprise the steps of contacting in an amount of sulfur from about 1% to about 5% by weight of the lubricant oil the elemental sulfur-lubricant oil mixture at a temperature from about 375° F. to 500° F. until the bulk of the elemental sulfur has reacted and the uncombined sulfur is less than 0.5% of the lubricant oil. Then cooling the oil to room temperature. In the process to manufacture the sulfurized lubricant oil, the lubricant oil may be contacted with from about 1% to about 4% of sulfur or preferably 2 to 3% of sulfur and the process may be reacted at a temperature of from about 400° F. to about 500° F. preferably 425° F. to 475° F.

DETAILED DESCRIPTION

Highly refined, solvent extracted, dewaxed lubricant oils are produced in the refinery. The processes which remove wax and extract undesirable hydrocarbon and non-hydrocarbon leave the oil essentially a poor solvent for sulfur. Unrefined lubricant distillate fractions contain compositions, removed by further refining, which readily solubilize sulfur. Some synthetic and naturally occurring materials other than mineral oil lubricant distillate fractions readily solubilize sulfur. Sulfurized mineral oils are desirable for their low cost and high quality of the finished products.

Lubricating oil stocks of the viscosities of interest are commonly produced by atmospheric, or vacuum distillation of crude oils. The boiling points of the desirable fractions are well known in the petroleum arts. Solvent extraction of lubricant distillate fractions are carried out using solvents such as phenol, furfural, and N-methyl-2-pyrrolidone. The solvent extractions are carried out in continuous, continuous counter-current, and batch processes. The amount of material removed in solvent extraction may be from 10 weight percent to as much as 60 weight percent of the oil.

The solvent extracted oils may be dewaxed. This process removes high molecular weight n-paraffins, certain isoparaffins, and cycloparaffins. In dewaxing processes the oil is contacted with a solvent or dual solvent which when cooled promotes the crystallization of the wax. Solvents used in dewaxing processes are methyl-ethyl ketone, benzene, propane, propylene-acetone dual solvent, methyl-ethyl ketone-benzene dual solvent and others.

Solvent extracted, dewaxed lubricant mineral oils which are fluid at reaction temperature may be used to produce the sulfurized compositions of this invention. The preferred lubricant oils have viscosities at 100° F. in the range of 60 to 500 Saybolt Universal Seconds.

During the reaction of the first addition of sulfur to the lubricating oil three things may happen to the sulfur. The sulfur may react with more reactive components of the lubricating oil combining directly with those components. The sulfur may react with the oil, abstracting hydrogen from the oil and be evolved from the oil mixture as hydrogen sulfide. The sulfur may not react with either hydrogen atoms from the oil or the oil components themselves and remain dissolved uncombined-free sulfur, and may also crystallize and settle out of the solution. It has been found that lubricant oil components which react with elemental sulfur are very effective solubilizing compositions for the production of free sulfur containing lubricant oils. The procedure is to add the required amount of sulfur to the mineral oil while maintaining a high temperature and suitable reaction time to produce a sulfurized mineral oil in which the sulfur reacts with more reactive components with the oil producing a sulfurized oil. Preferably, the amount of sulfur which is combined with the oil is limited to a maximum of 2%. A process has been discovered by which the predetermined amount of sulfur is chemically combined with a lubricant oil through a high temperature process to produce a stabilizing solubilizing oil. The solubilizing oil then at a much lower temperature is mixed with a second amount of elemental sulfur which is quickly solubilized and does not substantially react with a lubricant oil. The most preferable range of uncombined sulfur is between 1.10 and 1.50% by weight of sulfur based on the oil.

The reactions producing the sulfurized solubilizing oil and the final sulfurized cutting oil commonly are carried out in chemical batch processing units, but can also be carried out in continuous processing unit means. The processing units commonly have heating means for temperatures up to about 500° F. The processing units may also have cooling means. An inert gas blanket is commonly used to protect the oil and sulfur from oxidation and degradation during the solubilizing reaction. Nitrogen, steam, and process gas containing little or no oxygen may be used. The blanket of inert gas is commonly more important at the very high temperature to prevent oxidation of the sulfur and oil during the production of the sulfurized oil. Sulfur commonly is produced in many forms from fine powder form to large blocks. The sulfur is preferably added to the hot oil as a fine powder, and more preferably added in a molten state. The melting point of different forms of sulfur range from about 112.9° C. or about 235° F. to about 120° C. or about 238° F. The sulfur is preferably heated until molten and maintained at a temperature of from about 240° F. to about 310° F. The viscosity of molten sulfur greatly increases above about 310° F. Due to the viscosity increase pumping and transferring of molten sulfur becomes more difficult at elevated temperatures above 310° F. The sulfur may be kept under an inert blanket as described above. Piping and transfer equipment for sulfur must be maintained at a temperature at least about 240° F. to prevent crystallization and solidification of the sulfur during transport.

At the end of the process the sulfurized oil is generally analyzed for free sulfur. The amount of sulfur may be adjusted at this point adding sulfur to increase the sulfur content, and diluting with oil to reduce the sulfur content. Preservatives, perfumes, detergents and other additives may be added to the oil. These additives are used to improve the odor, appearance, cutting properties, and stability of the oil.

EXAMPLE I

A quantity of solvent extracted oil of 110 SUS viscosity at 100° F. is placed in a kettle. The oil is mixed and heated to a temperature from about 450° to about 460° F. The heated oil is blanketed with an inert gas to prevent oxidation at this high temperature. Molten sulfur in an amount of 2.15% of the oil by weight is added to the heated oil and the mixture is agitated for 1 hour. The mixture is cooled and an amount of solvent extracted 110 SUS equivalent to the original quantity of oil is mixed into the kettle. When the temperature is stable between about 250° and 260° F., sulfur in an amount equal to 1.05% of the total weight of oil is added to the kettle and the contents are mixed for 30 minutes. The mixture is cooled and ready for use.

EXAMPLE II

The procedure of sulfurization and cooling by oil addition is followed as in Example I. When the temperature is stable between 250°–260° F., sulfur in an amount equal to 1.25% of the total weight of oil is added to the kettle and the contents are mixed for 30 minutes. The mixture is cooled and ready for use.

EXAMPLE III

A quantity of solvent extracted oil of 170 SUS viscosity at 100° F. is placed in a kettle. The oil is mixed and heated to a temperature of from about 450° F. to about 460° F. The heated oil is blanketed with an inert atmosphere. In a quantity of sulfur 2.15% of the oil by weight is added to the heated oil. The mixture is maintained at the temperature and mixed for 1 hour and then cooled.

TABLE II

SULFUR FATE OF SULFUR SOLUBILIZING OILS OF EXAMPLE II

| Reaction Time (Min.) | Natural Sulfur (%)* | Sulfur (%) Initial Addition | Evolved $H_2S$(%) | Final Combined S(%) | Final Uncombined S(%) | Final Total S(%) |
|---|---|---|---|---|---|---|
| 45 | 0.21 | 2.5 | 1.11 | 0.93 | 0.67 | 1.60 |
| 60 | 0.21 | 2.5 | 1.56 | 0.98 | 0.17 | 1.15 |

*all (%) are in weight percent.

TABLE II shows the fate of sulfur which is added to produce the sulfur solubilizing oil in the first step. The major portion of sulfur reacts with the oil, of which a portion is chemically bound to the oil.

TABLE III

SOLUBILIZING EFFECT OF OIL IN EXAMPLE III

| Number | Ratio Sulfurized Oil/Diluent Oil | | Elemental Sulfur Added (%)* | Initial Free Sulfur (%) | Stable Free Sulfur (%) After 60 days at 40° F. |
|---|---|---|---|---|---|
| 1 | 0 | 100 | 1.5 | 1.0 | 0.4 |
| 2 | 10 | 90 | 1.5 | 1.5 | 0.5 |
| 3 | 20 | 80 | 1.5 | 1.37 | 1.32 |
| 4 | 30 | 70 | 1.5 | 1.43 | 1.42 |
| 5 | 40 | 60 | 1.5 | 1.46 | 1.53 |
| 6 | 40 | 60 | 2.0 | 1.86 | 1.37 |
| 7 | 50 | 50 | 1.25 | 1.40 | 1.36 |

I claim:

1. A process for the manufacture of a stable free sulfur containing mineral oil comprising the steps of:

(a) contacting a refined, solvent extracted lubricant oil with a first amount of elemental sulfur which is about 1 to about 5% by weight of the oil at a temperature of from about 375° F. to about 500° F. until the amount of the uncombined sulfur in solution is less than about 0.5% by weight of the lubricant oil to produce a lubricant oil-sulfur composition in which substantially all the first addition of sulfur remaining in the oil is chemically bound to oil molecules;

(b) cooling the lubricant oil-sulfur composition to a temperature from about 200° F. to 350° F.; and (c) contacting the lubricant oil-sulfur composition with second amount of elemental sulfur in an amount which results in a stable sulfurized oil which contains less than 1.6% uncombined sulfur in which substantially all the second addition of sulfur is in solution.

2. The process of claim 1 wherein the first amount of elemental sulfur is from about 1 to about 4% by weight of the lubricant oil.

3. The process of claim 2 wherein the first amount of elemental sulfur is from about 2 to about 3% by weight of the lubricant oil.

4. The process of claim 1 wherein the second amount of elemental sulfur is from about 0.9 to about 1.5% by weight of the lubricant oil.

5. The process of claim 1 wherein the lubricant oil is selected from a group of solvent extracted lubricant oils which have viscosities at 100° F. in the range of about 60 to about 500 Saybolt Seconds.

6. A process for the manufacture of stable free sulfur mineral oil composition comprising:

(a) heating a refined, solvent extracted lubricant oil to a temperature from about 425° F. to about 475° F.;

(b) contacting the heated solvent extracted oil with a first amount of elemental sulfur which is from about 2% to about 3% by weight of the oil and reacting the oil and the sulfur for a period until the concentration of the uncombined sulfur in solution is less than 0.5% weight of the oil producing an oil-sulfur composition in which the substantially all the first addition of sulfur remaining in the oil is chemically bound to the oil molecules;

(c) cooling the oil-sulfur composition to a temperature of from about 250° to 275° F. by adding lubricant oil;

(d) contacting the oil-sulfur composition with a second amount of sulfur which is from about 1.0 to about 1.5% by weight of the oil mixture until substantially all the second addition of sulfur is essentially fully dissolved;

(e) cooling the product to about ambient temperature.

7. A process to manufacture a sulfurized mineral lubricant oil solubilizing agent for elemental sulfur comprising the steps:

(a) contacting a refined, solvent extracted lubricant oil with from about 1% to about 5% by weight elemental sulfur based on lubricant oil;

(b) heating the elemental lubricant sulfur-oil mixture at a temperature of from about 375° F. to about 500° F. until the bulk of the sulfur has reacted with the oil and is chemically bound to the oil molecules and the uncombined sulfur concentration is less than 0.5% by weight of the oil;

(c) cooling the solubilizing agent.

8. The process of claim 7 wherein the lubricant oil is contacted with from about 1% to about 4% by weight of elemental sulfur based on lubricant oil.

9. The process of claim 7 wherein the lubricant oil is contacted with from about 2% to about 3% by weight of elemental sulfur based on lubricant oil.

10. The process of claim 7 wherein the elemental sulfur and the lubricant oil is reacted at a temperature of from about 400° to about 500° F.

11. The process of claim 7 wherein the lubricant oil and the elemental sulfur is reacted at a temperature of from about 425° F. to about 475° F.

12. The product of the process of claim 1.

13. The product of the process of claim 6.

14. The product of the process of claim 7.

* * * * *

UNITED STATES PATENT OFFICE
CERTIFICATE OF CORRECTION

Patent No. 4,125,471 Dated November 14, 1978

Inventor(s) Paul C. Vienna, Marvin J. DenHerder and Alex Zletz

It is certified that error appears in the above-identified patent and that said Letters Patent are hereby corrected as shown below:

| Patent Col. | Patent Line | |
|---|---|---|
| 1 | 36 | "ols," should read -- oils, -- |
| 2 | 12 | "(about" should read -- about -- |
| 3 | 2 | "retracted" should read -- reacted -- |
| 3 | 44 | "viscosity 100°F" should read -- viscosity at 100°F -- |
| 7 | 35 | "0.5% weight" should read -- 0.5% by weight -- |

Signed and Sealed this

Third Day of July 1979

[SEAL]

Attest:

Attesting Officer

LUTRELLE F. PARKER

Acting Commissioner of Patents and Trademarks